US005419677A

United States Patent [19]

Cohn

[11] Patent Number: 5,419,677

[45] Date of Patent: May 30, 1995

[54] APPARATUS AND METHOD FOR PROGRAMMABLE INTERLEAVING AND STACKING OF SHEET-CARRIED FOOD PRODUCTS

[76] Inventor: Robert Cohn, 1210 Jackson St., Omaha, Nebr. 68102

[21] Appl. No.: 53,430

[22] Filed: Apr. 28, 1993

[51] Int. Cl.[6] ..... B65G 57/04

[52] U.S. Cl. ..... 414/789.5; 198/460.3; 271/197; 414/793.8; 414/791

[58] Field of Search ..... 53/DIG. 1; 198/431, 198/460; 414/799, 789.5, 789.8, 791, 793.8, 794.4; 271/276, 197

[56] References Cited

U.S. PATENT DOCUMENTS

| | | | |
|---|---|---|---|
| 3,084,491 | 4/1963 | Solomon | 271/197 |
| 3,355,166 | 11/1967 | Plumb | 271/276 |
| 3,870,139 | 3/1975 | Wagner . | |
| 3,959,951 | 6/1976 | Paules | 414/789.5 |
| 4,236,855 | 12/1980 | Wagner et al. | 414/789.5 |
| 4,469,219 | 9/1984 | Cossé | 198/460 |
| 4,530,632 | 7/1985 | Sela | 271/197 |
| 4,532,751 | 8/1985 | Mally et al. . | |
| 4,690,269 | 9/1987 | Takao | 198/460 |
| 4,852,717 | 8/1989 | Ross et al. | 198/460 |
| 5,038,915 | 8/1991 | Delsanto | 198/460 |

*Primary Examiner*—Michael S. Huppert
*Assistant Examiner*—Gregory A. Morse
*Attorney, Agent, or Firm*—Evelyn M. Sommer

[57] ABSTRACT

An apparatus and method for interleaving a carrier sheet with sliced food products, such as bacon strips, has a supply conveyor for continuously conveying products with spacings that may be random or non-uniform, a delivery section to a drop-off point, a detector for detecting the position of each product from the drop-off point, a sheet supply source, an indexing conveyor for moving the carrier sheet to receive products at the drop-off point in timed relation to arrival of the products, a counter for counting down the arrival of each product to the drop-off point, and a programmable controller for controlling the advance of the carrier sheet to the drop-off point and incrementally thereafter to receive successive products in timed relation thereon. The preferred embodiment draws and cuts each carrier sheet from a supply paper roll. The indexing conveyor has a perforated belt and holds the carrier sheet on the belt by vacuum pressure. Multiple interleaver lines can be set up in side to side relation. A stacking mechanism has a reciprocating, telescoping conveyor for depositing successive product-laden sheets on a stack, and an elevator for adjusting the height of the stack below the telescoping conveyor.

11 Claims, 6 Drawing Sheets

APPARATUS AND METHOD FOR PROGRAMMABLE INTERLEAVING AND STACKING OF SHEET-CARRIED FOOD PRODUCTS

FIELD OF THE INVENTION

This invention generally relates to an apparatus and method for interleaving sliced food products with a carrier sheet and stacking of the sheet-carried output units, and particularly using programmable control of such interleaving and stacking under continuous, high-speed conveying of the sliced food products.

BACKGROUND ART

Apparatus used for packaging bacon, cold cuts, and other types of sliced food products into output packaged units typically convey the sliced food products from an upstream food processing station, such as a slicer, cooking oven, and the like, to an interleaving station where a carrier sheet is positioned to receive the sliced food products in overlapping or shingled arrangement thereon. When a predetermined number of sliced food products have been arranged on the carrier sheet, the output unit is transferred to a downstream wrapping or stacking station for output packaging.

Prior interleaving apparatus have generally used controls to deposit the sliced food products on a conveyor in groups separated by gaps or to halt the conveying of food products as each group of food products is conveyed to a receiving station to be deposited on a carrier tray or other transport member. For example, in U.S. Pat. No. 4,532,751 to Mally et al., the food products are deposited on a supply conveyor separated by gaps between groups, and when a detector detects a gap in the food products, an interleaver control cuts the trailing edge for a current carrier sheet and advances it from the receiving station while advancing the leading edge for the next carrier sheet to the receiving station. The conventional equipment has limitations in that it cannot accept food products that are randomly or continuously arranged on the conveyor, nor can it properly handle food products where the spacing between products or the gap between groups of food products are not precisely maintained.

Other food packaging systems, such as shown in U.S. Pat. No. 4,690,269 to Takao, and U.S. Pat. No. 4,852,717 to Ross et al., have controlled the speed of a downstream receiving conveyor for receiving a number or group of food articles in response to detection of the food articles on an upstream supply conveyor so that the articles can be accurately transferred in groups in a desired spaced relation even though the articles may not be a constant distance apart on the food supply conveyor. U.S. Pat. No. 3,870,139 to Wagner teaches the concept of operating the receiving conveyor at a lower speed than the supply conveyor to receive food articles in a shingled arrangement thereon, then operating it at a higher speed to advance a deposited shingled group to an output. However, the prior systems have not satisfactorily provided for the automatic interleaving of carrier sheets cut from a roll to receive food products supplied randomly or continuously on a supply conveyor, nor for automatic stacking of a number of output units of sheet-carried sliced food products for final packaging.

SUMMARY OF THE INVENTION

In accordance with the present invention, an apparatus and method for interleaving a carrier sheet with a number of products to be arranged thereon comprises: a supply conveyor for continuously conveying products thereon with spacings between products which may be random or non-uniform; a delivery section for continuously delivering products from the supply conveyor to a drop-off point; a product detector for detecting passage of each product at a predetermined detection position from the drop-off point of said delivery section; a sheet supply source for supplying a carrier sheet to receive products thereon; an indexing conveyor for moving a carrier sheet supplied by said sheet supply source to receive products at the drop-off point in timed relation to arrival of the products at the drop-off point; a counter for counting down the arrival of each product from the detection position to the drop-off point; and a programmable controller for controlling said indexing conveyor so as to advance the carrier sheet a first incremental amount to bring the carrier sheet from said sheet supply source to an operative position to receive a first product from the drop-off point, and a second incremental amount for receiving each successive product in timed relation to arrival of the products at the drop-off point as determined by said counter in response to detection of each product by said product detector.

In the preferred embodiment for interleaving carrier sheets with bacon strips, the delivery section includes a bacon stripper member and an overhead conveying mechanism. The sheet supply source includes a pinch roll and draw roll for drawing paper from a supply roll, and a knife for cutting a predetermined length of carrier sheet from the supply roll. The indexing conveyor has a perforated belt in communication with a vacuum pressure source for holding the carrier sheet on the belt by vacuum pressure. A servo motor is used to control the indexing conveyor and the sheet draw rolls. Multiple interleaver lines can be set up in side to side relation. The output section has a stacking mechanism for stacking a predetermined number of product-laden sheets in a stack. The stacking mechanism has a telescoping conveyor reciprocatingly movable between an extended position and a retracted position for depositing each product-laden sheet successively on a stack, and an elevator which adjusts the height of the stack below the telescoping conveyor.

Other objects, features and advantages of the present invention are described in greater detail below in conjunction with the drawings.

DETAILED DESCRIPTION OF THE INVENTION

Figure 1:
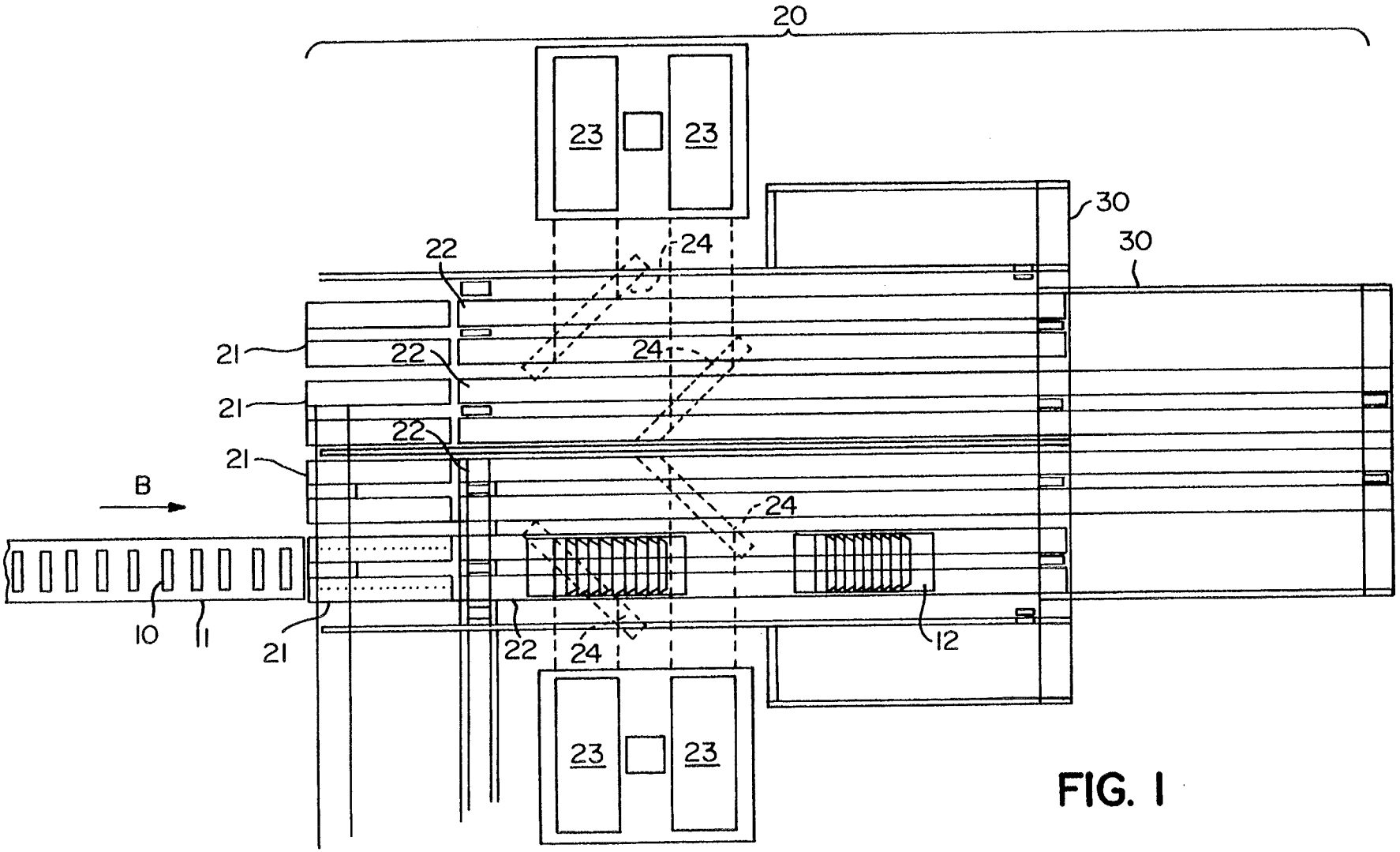
FIG. 1 shows a plan view of an interleaving station for receiving sliced food products on cut sheets in accordance with the present invention.

Referring to FIGS. 1–4, a preferred embodiment of a programmed interleaving apparatus is shown for automatically placing randomly or continuously conveyed sliced food products such as bacon strips on cut carrier sheets. The bacon strips are to be placed in uniformly spaced shingled arrangement or any other desired pattern on the carrier sheet. As shown in FIG. 1, the equipment is built to take cooked bacon strips 10 conveyed continuously on a supply conveyor 11 driven by conveyor rolls 11*a*, 11*b* in the direction of arrow "B" from an upstream food processing station (not shown) such as a slicer, cooker, and the like. More than one supply conveyors may be used or, alternatively, the bacon may be sliced and laid on a single extra-wide supply conveyor in multiple columns. As the bacon strips are conveyed on the supply conveyor 11, human inspectors or computerized monitors may remove pieces that are not salable because of incorrect size or condition. This would leave gaps and varying spaces between good slices resulting in irregular arrangement on the supply conveyor 11 from time to time.

Interleaving Station

The interleaving station 20 has a delivery section 21 to receive the continuously conveyed bacon strips and a sheet transport section 22 for advancing cut paper sheets from a roll to receive the bacon strips thereon. For a system which has multiple incoming lines or columns of bacon strips, a corresponding number of delivery sections 21 and sheet transport sections are provided. The paper sheets for the respective interleaving lines are provided from paper rolls housed in unwind stands 23 and turned through ninety degress on turn bars 24 into alignment with the interleaving lines. The output units 12 of sheet-carried bacon strips are then transferred from an output section 30 to a stacking station (to be described further below).

Figure 2:
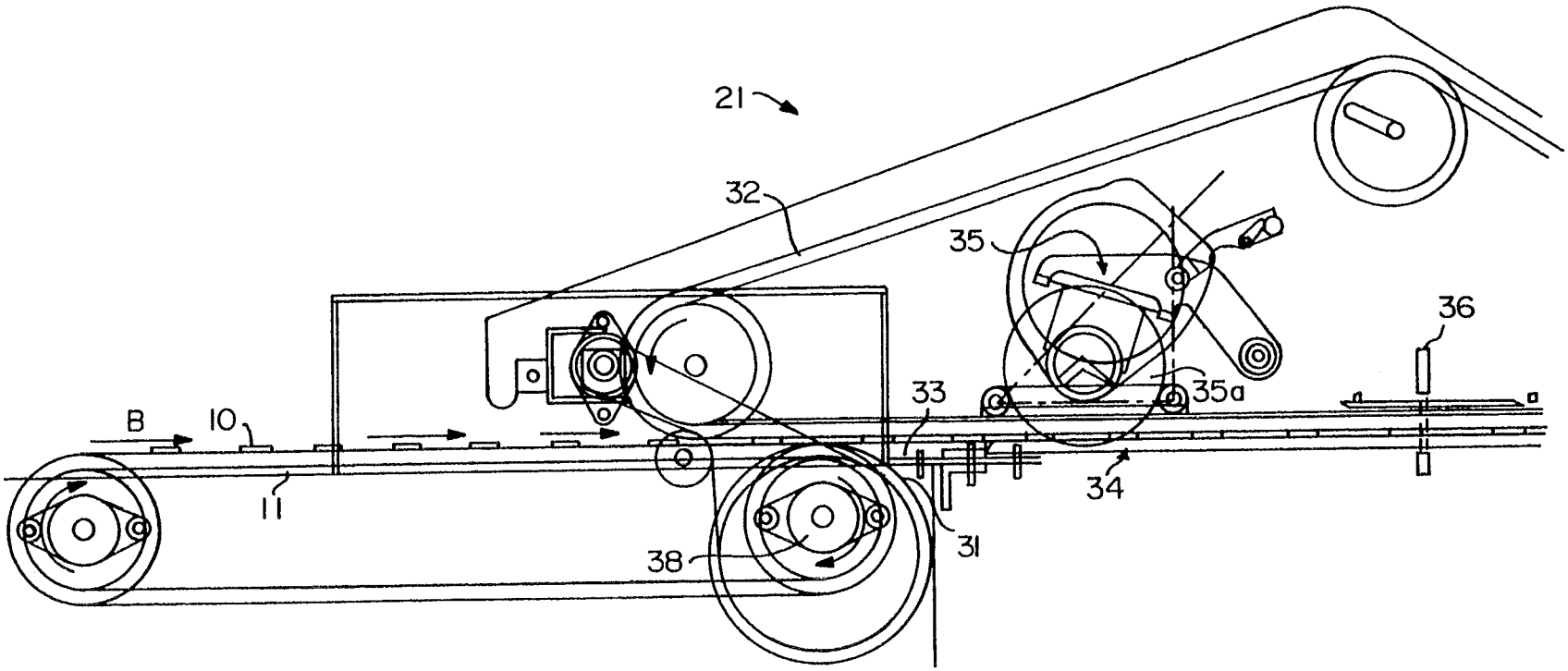
FIG. 2 shows a side schematic view of an input end of a delivery section to the interleaving station of FIG. 1.

Referring to FIG. 2, as the bacon strips 10 are transported in the direction of the arrow "B" from the supply conveyor 11 to the delivery section 21 for the interleaving station, they are raised off the conveyor 11 on a raised rib of a separation member 31 and moved by an upper traction belt 32 over a comb 33 so that they are stripped from the conveyor 11 and moved along a bridge plate 34. The separation member may be a commercial unit, for example, as sold under the name Intralox Series 900 by Intralox, Inc., located in Harahan, La. The delivery section 21 can include a splitter assembly 35 composed of a mounting, motor, and a circular knife 35*a* for cutting the input bacon strip into smaller pieces, as may be desired for certain uses such as fast foods, etc. The circular knife 35*a* cuts through a slot in the bridge plate 34.

Figure 3:
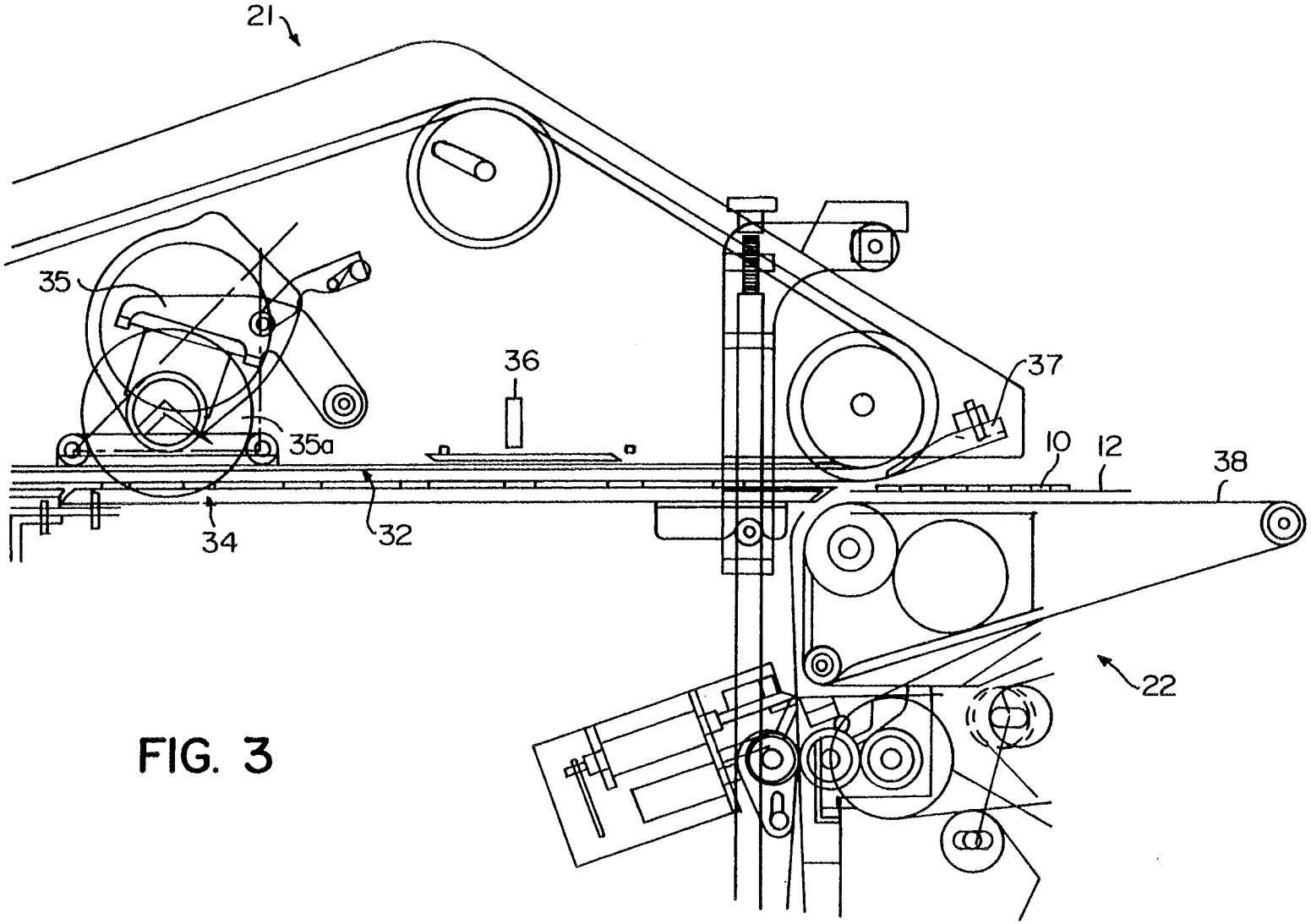
FIG. 3 shows a side schematic view of an output end of the delivery section to the interleaving station.

As shown in FIG. 3, the delivery section 21 has an optical sensor 36 which detects each bacon strip 10 as it passes along the bridge plate 34. The sensor 36 is connected to a shift register circuit which counts down the distance for transport of the bacon strip 10 to the end of the delivery section 21 based upon its detected position and the distance and speed it is moved by the traction belt 32. At the output end of the delivery section 21, a comb 37 positively removes the bacon strip 10 from the belt 32 where it drops onto a carrier sheet 12 positioned to receive a predetermined number of the bacon strips.

Figure 4:
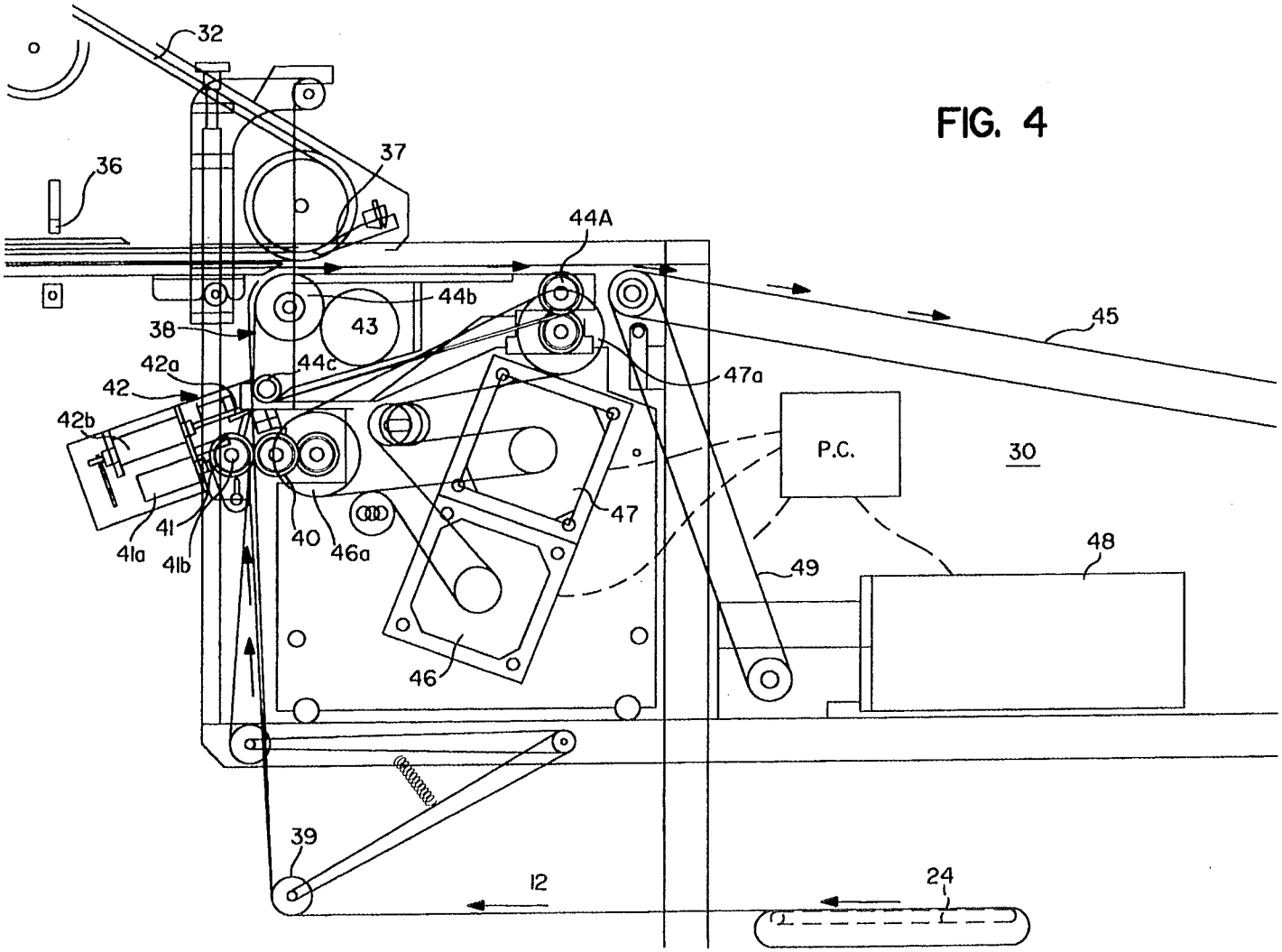
FIG. 4 shows a side schematic view of a sheet transfer section for the interleaving station.

As shown in greater detail in FIG. 4, the carrier sheet 12 held by vacuum force on a programmably indexed conveyor 38 of the sheet transport section 22. The paper unwound from the unwind stand 23 and turned on the turn bar 24 is pulled over a spring-biased roll 39 up between a draw roll 40 and pinch roll 41 (indicated by the arrows in FIG. 4). Pinch roll 41 is a 60-durometer, resilient plastic roll (U.S.D.A. approved) that is friction driven by draw roll 40. Pressure for friction driving of the paper between the rolls 40 and 41 is provided by two pressure-regulated air cylinders 41*a* pushing on a bearing retainer that pivots the shaft 41*b* supporting the pinch roll 41.

The paper continues upward past the knife 42 having a stationary part and a moveable part. The moveable part 42*a* is activated by two air cylinders 42*b*. The moveable part 42*a* is tensioned against the stationary part in order to cut the paper by a scissor action when the cylinders 42*b* are activated. The cut paper sheet is held to the conveyor 38 by vacuum force and advanced under the drop-off point for the bacon strips in accordance with an indexing control to be described further herein. Vacuum pressure is provided within the internal space of the conveyor 38 from a duct 43 to a vacuum source, and the belt 38 has perforations for holding the sheet against the belt. When a sheet has been loaded with the predetermined number of bacon strips from the delivery section 21, the conveyor 45 is driven at an elevated speed to advance the sheet with loaded bacon in output section 30. The output conveyor is driven by a drive motor 48 through a drive belt 49.

The vacuum conveyor assembly includes a drive roll 44*a* and two idler rolls 44*b*, 44*c*. The drive roll 44*a* has teeth cut for 1/5 pitch timing belts. The idler rolls do not have timing belt teeth, but have radial slots cut under the position of the conveyor belt 38 so that vacuum pressure in the internal housing can communicate around the rolls. When multiple interleaver lines are arranged side to side, vacuum pressure is passed through the side frames of the vacuum housings through the hole 43. The vacuum is supplied by a low pressure blower creating a vacuum pressure of about one-inch water column.

A servo motor located at position 46 or 47 is indexed to pull a tensioned belt entrained around idler pulleys to drive the driven pulley 46*a* which drives the draw roll 40 to advance the paper to the vacuum conveyor 38. The servo motor is also indexed to pull a tensioned belt entrained around idler pulleys to drive the driven pulley 47*a* which drives the drive roll 44*a* to advance the conveyor belt 38. The servo 46 is indexed to advance the paper 12 and the servo 47 is indexed to drive the conveyor 38 with separate indexing movements as described hereinafter. The conveyor belt 38 is driven at a slightly faster speed than the paper to keep a certain amount of draw tension on the paper. The servo motors, cylinder actuators, and drive motors for the conveyor belts are all connected to a programmable controller (P.C.) for overall control of the system.

In actual operation, bacon strips are advanced continuously with a spacing that may be random and taken from the supplier conveyor 11 by the delivery section 21. The passage of each bacon strip is detected by the optical sensor 36, which signals a shift register in a programmable controller circuit to count down the distance of the bacon piece toward the drop-off point to the vacuum conveyor 38. For example, a magnetic pickup on a drive shaft for the traction belt 32 can be used to provide an incremental belt movement signal for counting down. The shift register is thus used to retain a positive location of the bacon piece until the drop-off point.

As or just before the bacon piece drops off onto the sheet on the conveyor belt 38, the servo motor located at 46 or 47 indexes the draw roll 40, the paper, and the conveyor belt 38 a specific programmed amount for precisely locating the bacon piece on the sheet. For example, the sheet can be indexed a uniform amount less than the width of the bacon piece to arrange the pieces on the sheet in overlapping, shingled fashion. Alternatively, any desired pattern of arrangement on the sheet may be implemented by suitable programming of the indexing sequences. This stepwise indexing continues until a specified number of pieces are placed on the paper, then the program control activates the knife cylinders 42*b* to cut the paper, and also drives the drive roll to advance the laden sheet to the output conveyor 45 while at the same time advancing the leading (cut) edge of the paper in position to receive the next specified number of bacon pieces at the drop-off point. With this mode of operation, the spacings between bacon pieces on the supply conveyor do not have to be uniform nor driven at a constant speed differential relative to the traction belt 32 or the vacuum conveyor belt 38. Instead all adjustments for placing the bacon pieces on the carrier sheet are made by counting down the precise location of each piece to the drop off point and programmed control of the sheet indexing.

Product Sheet Stacking Mechanism

Figure 5:
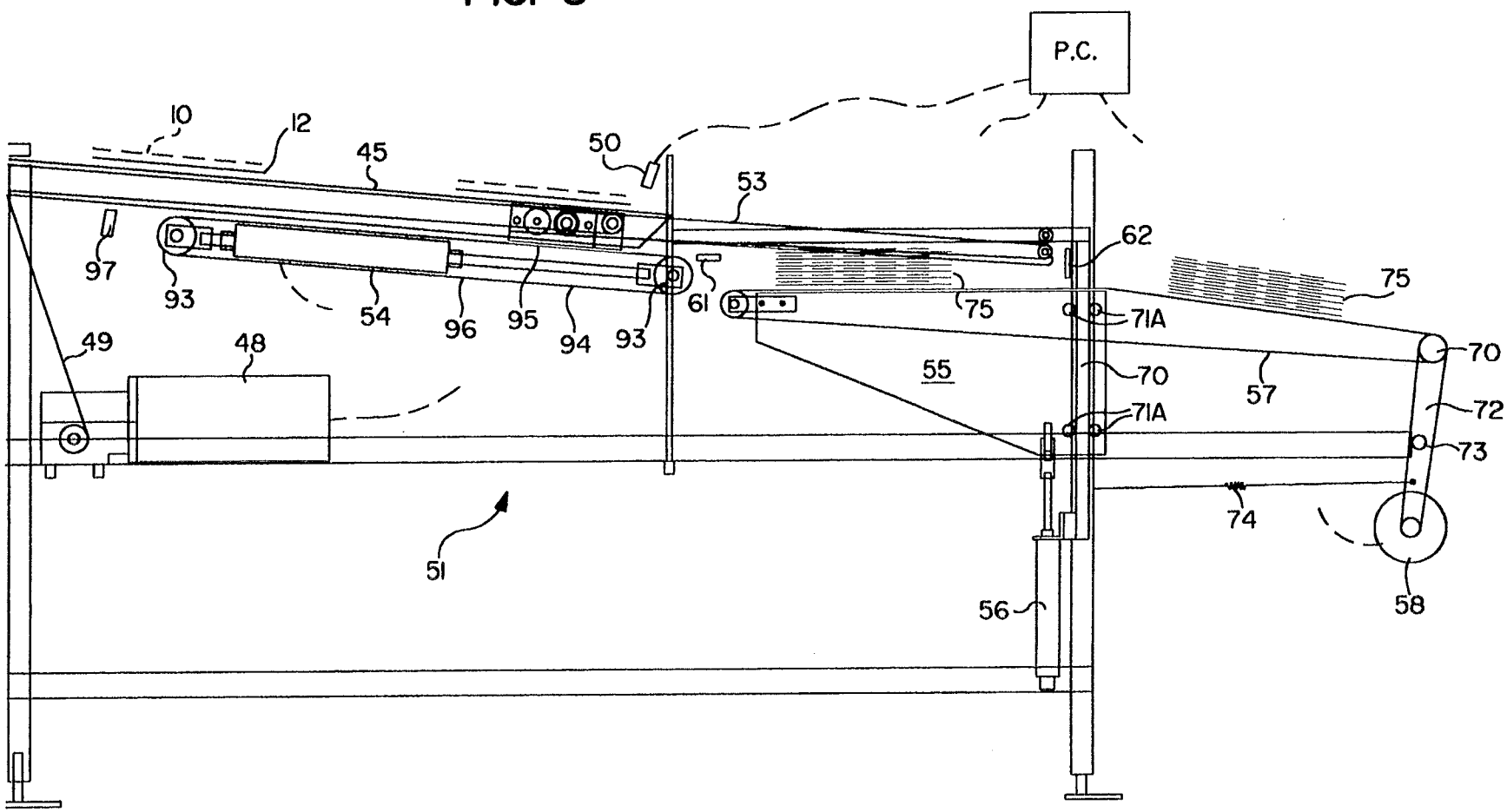
FIG. 5 shows a side view of a stacking mechanism for stacking of sheet-carried sliced food products output from the interleaving station.

Referring to FIG. 5, the output section 30 of the interleaving station may include a product sheet stacking mechanism for stacking a number of product-laden sheets for final wrapping or packaging. The sheet stacking mechanism includes a frame 51, the output conveyor 45, a telescoping conveyor 53 (shown in FIG. 5 in its extended position), a telecoping actuating cylinder 54, a stacking elevator 55, a stacking elevator control cylinder 56, a take-away conveyor 57, and a take-away conveyor motor 58. The output conveyor 45 is driven by the variable speed motor 48 through the belt 49. The speed of this conveyor is controlled to accept the sheets 12 carrying the sliced food products at a higher rate than the transport speed so that the sheets are separated from each other by a spacing of about one sheet length.

When a photocell 60 detects a sheet 12, it signals a delay timer in the programmable controller (P.C.) for the system. A timer in the controller actuates the cylinder 54 to extend the telescoping conveyor 53 at a constant speed. The cylinder 54 has its piston rod extending through both ends of the cylinder, and each end mounts a belt pulley 93. A belt 94 is entrained over the two pulleys 93 and is attached to frame rails for the output conveyor 45 at the point 95. The belt 94 is also attached to a cylinder mount at point 96. This assembly allows the cylinder 54 to reciprocate the telescoping conveyor 53 with a piston travel that is one-half the amount of travel of the telescoping conveyor 53. The retraction of the telescoping section 53 is controlled such that the belt movement is stationary with respect to the stacking elevator. This allows a sheet to be transferred smoothly from the telescoping conveyor 53 and gently laid on top of the stack 75 being formed.

When a product sheet has passed the photocell 60, the cutoff of the photocell 60 triggers a second time interval in the programmable controller that allows the cylinder 54 to retract the telescoping conveyor 53. The stacking elevator is lowered by the cylinder 56 with a rolling movement of the wheels 71*a* along the frame part 70 to prepare the stack level to receive the next sheet. Detection of a next carrier sheet 12 triggers the next sheet laying-down cycle. Continuous supply of the product-laden sheets and reciprocating movement of the telscoping conveyor 53 results in a desired stack of sheets being evenly built up. Each passage of a sheet beneath the photocell 60 also triggers a counter in the programmable controller P.C. When the counter reaches a predetermined set count, the telescoping conveyor is fully retracted (as detected by a proximity switch 97), then the take-away motor 58 is actuated to drive the take-away conveyor 57 to move the stack to its final output. The take-away conveyor 57 is driven by the roller 71*b* which in turn is driven by a drive belt 58*a* coupled to the motor 58.

The take-away motor 58 and conveyor roller 71*b* are mounted on a bar 72 that pivots on a shaft 73. The shaft 73 holds the belt 57 in tension with a spring 74. This tension assembly keeps belt 57 in contact with the drive roll 71 while the stacking elevator 55 is raised and lowered. The height of the elevator 55 is regulated by a photocell 61 detecting a reflection from reflector 62 in a line of sight over the top of the stack 75. When the telescoping conveyor 53 fully retracts and a completed stack is transferred to the output, the cylinder 56 is actuated to raise the elevator 55 until its level is again raised to the level for receiving sheets for the next stack.

Figure 6:
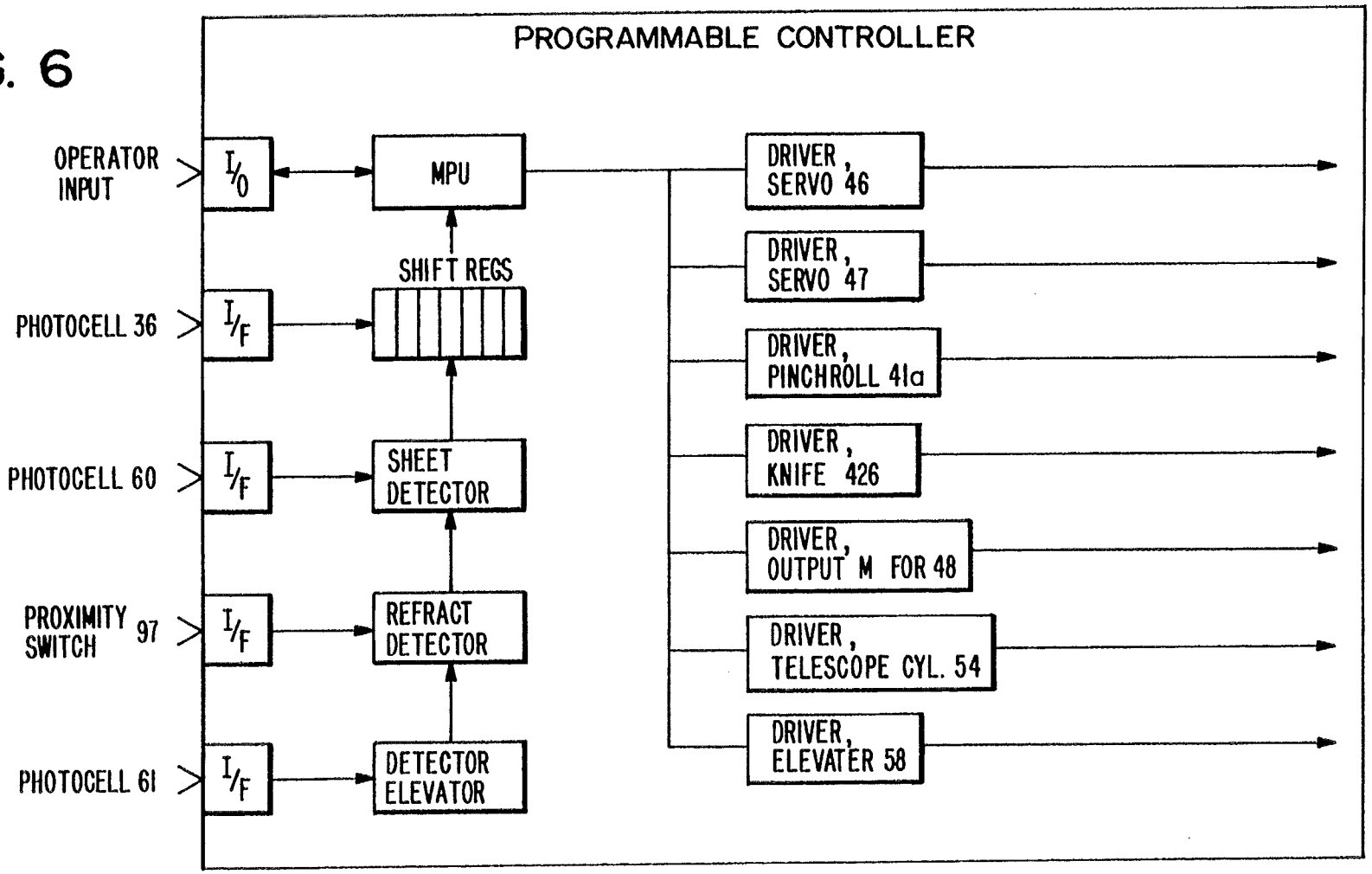
FIG. 6 illustrates the components of a programmable controller for the interleaving station and stacking mechanism.

The programmable controller P.C. is implemented with known programming techniques and controller components. As illustrated in FIG. 6, the controller includes inputs from the operator and the sensors used in the system, a microprocessor (MPU) for performing the interleaving and stacking program, shift registers for counting down the drop-off of bacon pieces, outputs to drivers for the servo motors, telescoping cylinder, elevator, and other actuatable components of the system.

The operator initially provides an input to the programmable controller to open the pinch roll for the carrier sheet. The operator can then thread the leading end of a sheet into the sheet feeding and cutting section. Another operator input then causes closing of the pinch roll, and initiation of the P.C. program which starts conveyor motor 48 to advance the sheet. Under P.C. program control, the system cuts the paper and advances the cut paper edge to the drop off point. The system then waits for an input from photocell 36 indicating detection of a bacon slice on the conveyor 11. Upon a detection signal from photocell 36, the shift register starts to count down based upon a distance-travelled signal provided from the magnetic pickup for the belt 32. The shift register counts down and activates the driver for the servo motor to advance the paper a programmed incremental amount. Successive signals from the photocell 36 similarly activates each of the programmed indexing steps. When a prescribed number of units have been counted, the knife assembly cuts the paper, the laden paper is advanced from the drop-off station, and the program repeats for the next loading sequence.

For the stacking program, the sheeted product unit is advanced on conveyor 45. The leading edge of the paper is detected by photocell 60, which times out and causes activation of the telescoping cylinder to extend conveyor 53. The trailing edge of the paper is detected by photocell 60, which times out and de-activates cylinder 54 to retract conveyor 53. The height of the stack is detected by photocell 61. Interruption of the photocell beam and return detection by proximity switch 97 result in activation of cylinder 56 to lower the elevator 55. The number of retractions of the conveyor 53 detected by proximity switch 97 is counted, and motor 58 is activated to advance conveyor belt 57 for a programmed period of time. The stop time for motor 58 resets the count for photocell 60, proximity switch 97, and photocell 61. Alternatively, an operator input can actuate motor 58 and reset the counts for restarting the machine upon initialization or after cleaning.

Although the invention has been described with reference to certain preferred embodiments, it will be appreciated that many other variations and modifications thereof may be devised in accordance with the principles disclosed herein. While an embodiment has been described adapted to loading and stacking of food products, the invention is not limited thereto but may be adapted to other types of products to be carried on a sheet and stacked. The invention, including the described embodiments and all variations and modifications thereof within the scope and spirit of the invention, is defined in the following claims.

I claim:

1. An apparatus for interleaving a carrier sheet with a number of products to be arranged thereon, comprising:

a supply conveyor for continuously conveying products thereon with spacings between products that may be random or non-uniform;

a delivery section for continuously delivering products from the supply conveyor to a drop-off point;

a product detector for detecting passage of each product at a predetermined detection position from the drop-off point of said delivery section and for providing a detection signal for each product passing the detection point;

a roll sheet supply source for supplying a carrier sheet from a continuous roll of paper to the drop-off point to receive products thereon;

paper cutting means positioned proximate said roll sheet supply source for cutting a carrier sheet from the roll of continuous paper upon activation thereof;

an indexing conveyor for moving a carrier sheet supplied by said roll sheet supply source to receive products at the drop-off point in timed relation to arrival of the products at the drop-off point;

a counter for counting down the arrival of each product from the detection position to the drop-off point; and a programmable controller operatively coupled to said product detector, said counter, said indexing conveyor, and said paper cutting means for controlling said indexing conveyor so as to advance a leading edge of the carrier sheet from the roll of continuous paper by a first incremental amount to bring the leading edge of the carrier sheet from said roll sheet supply source to an operative position to receive a first product from the drop-off point, and to advance the carrier sheet successively by a second incremental amount for receiving each successive product in timed relation to arrival of the products at the drop-off point as determined by said counter in response to detection of each product by said product detector, said programmable controller further having means for activating said paper cutting means to cut off a trailing edge of the carrier sheet from a leading edge of a next carrier sheet when a predetermined number of products have been detected as passing the detection point based upon the detection signals received from said product detector, and for thereafter controlling the indexing conveyor to advance the carrier sheet with the products arranged thereon away from the drop-off point and at the same time advancing the leading edge of the next carrier sheet in position to receive products next delivered to the drop-off point.

2. An apparatus according to claim 1, wherein said delivery section includes a stripper member and an overhead conveying mechanism for transporting the products to the drop-off point.

3. An apparatus according to claim 1, wherein said sheet supply source includes a pinch roll and a draw roll for drawing a leading edge of a sheet between them from a supply roll, and a cutting member for cutting a predetermined length of a carrier sheet from the sheet drawn from said supply roll.

4. An apparatus according to claim 1, wherein said indexing conveyor includes a vacuum pressure source and a perforated belt in communication with said vacuum pressure source for holding each carrier sheet on said belt by vacuum pressure.

5. An apparatus according to claim 1, wherein said indexing conveyor includes a draw roll and idler rolls over which a conveyor belt is entrained, and a servo motor controlled by said programmable controller for driving said draw roll to advance said belt an indexed amount relative to said drop-off point.

6. An apparatus according to claim 3, wherein said sheet supply source includes a servo motor controlled by said programmable controller for driving said draw roll to advance the sheet an indexed amount past said cutting member.

7. An apparatus according to claim 1 further comprising a plurality of the aforementioned apparatus for interleaving a carrier sheet with products in side to side relation.

8. An apparatus according to claim 1 further comprising an output section having a stacking mechanism for stacking a predetermined number of product-laden sheets in a stack.

9. An apparatus according to claim 8, wherein said output section and stacking mechanism include an output conveyor for receiving the product-laden sheets thereon in spaced apart relation, a telescoping conveyor reciprocatingly movable between an extended position and a retracted position for depositing each product-laden sheet successively on a stack, and an elevator for the stack having height level adjusting means for adjusting a height of the stack below said telescoping conveyor in order to receive each successive product-laden sheet on the stack.

10. An apparatus according to claim 9, wherein said elevator includes a take-away conveyor for moving a completed stack to a final take-away position.

11. A method for interleaving a carrier sheet with a number of products to be arranged thereon, comprising:

continuously conveying products from a supply source, with spacings between products that may be random or non-uniform, to a drop-off point;

detecting passage of each product at a predetermined detection position from the drop-off point;

supplying a carrier sheet from a continuous roll of paper from a sheet supply source to receive products thereon and cutting a carrier sheet from the continuous roll of paper with a paper cutting means upon activation thereof;

indexing the movement of the carrier sheet from the sheet supply source to receive products at the drop-off point in timed relation to arrival of the products at the drop-off point;

counting down the arrival of each product from the detection position to the drop-off point; and programmably controlling the indexing of the carrier sheet so as to advance a leading edge thereof from the sheet supply source by a first incremental amount to bring the leading edge of the carrier sheet to an operative position to receive a first product from the drop-off point, and successively advancing the carrier sheet by a second incremental amount for receiving each successive product in timed relation to arrival of the products at the drop-off point in response to counting down from the detection position to the drop-off point, and further activating said paper cutting means to cut off a trailing edge of the carrier sheet from a leading edge of a next carrier sheet upon counting a predetermined number of products passing the detection point, and thereafter advancing the cut-off carrier sheet with the products arranged thereon away from the drop-off point and at the same time advancing the leading edge of the next carrier sheet in position to receive products next delivered to the drop-off point.

* * * * *